US011225811B2

(12) United States Patent
Lipka et al.

(10) Patent No.: US 11,225,811 B2
(45) Date of Patent: Jan. 18, 2022

(54) METHOD FOR DETECTING A CHANGE OF A STATE OF A LOCK AND A SYSTEM FOR DETECTING A CHANGE OF A STATE OF A LOCK

(71) Applicant: Locky Sp. z o.o., Jasionka (PL)

(72) Inventors: Dariusz Lipka, Cracow (PL); Mariusz Zdzislaw Bajor, Myslenice (PL); Sebastian Religa, Cracow (PL); Grzegorz Gornisiewicz, Brzostek (PL)

(73) Assignee: LOCKY SP. Z O.O., Jasionka (PL)

( * ) Notice: Subject to any disclaimer, the term of this patent is extended or adjusted under 35 U.S.C. 154(b) by 330 days.

(21) Appl. No.: 16/221,639

(22) Filed: Dec. 17, 2018

(65) Prior Publication Data

US 2019/0390479 A1 Dec. 26, 2019

(30) Foreign Application Priority Data

Jun. 22, 2018 (PL) ..... P.426034

(51) Int. Cl.
*E05B 19/22* (2006.01)
*G07C 9/00* (2020.01)
*E05B 49/00* (2006.01)

(52) U.S. Cl.
CPC ..... *E05B 19/22* (2013.01); *E05B 49/004* (2013.01); *G07C 9/00944* (2013.01); *G07C 2009/00952* (2013.01)

(58) Field of Classification Search
CPC ... E05B 49/004; E05B 19/22; G07C 9/00944; G07C 2009/00952
USPC ..... 70/432, 278.3
See application file for complete search history.

(56) References Cited

U.S. PATENT DOCUMENTS

| | | | | |
|---|---|---|---|---|
| 8,269,644 | B2 * | 9/2012 | Weinstein | E05B 19/22 340/686.1 |
| 2004/0103702 | A1 * | 6/2004 | Abeler | H01H 29/20 70/408 |
| 2009/0064746 | A1 | 3/2009 | Bigdely Shamlo | |
| 2016/0343181 | A1 * | 11/2016 | Cheng | G07C 9/00309 |
| 2020/0265662 | A1 * | 8/2020 | Maiga | E05B 17/2007 |

FOREIGN PATENT DOCUMENTS

| | | |
|---|---|---|
| DE | 4327294 | 7/1994 |
| WO | WO2008057024 | 5/2008 |

* cited by examiner

*Primary Examiner* — Suzanne L Barrett
(74) *Attorney, Agent, or Firm* — Mark M. Friedman

(57) ABSTRACT

A method for detecting a change of a state of a lock by means of a device connected to a key for that lock. The method includes measuring a change of a position of the key about three axes; and indicating that the state of the lock has changed if the measured change of position of the key indicates that the key has rotated about a first axis by an angle greater than or equal to a primary threshold value and about the other two axes by an angle smaller than a secondary threshold value.

12 Claims, 5 Drawing Sheets

METHOD FOR DETECTING A CHANGE OF A STATE OF A LOCK AND A SYSTEM FOR DETECTING A CHANGE OF A STATE OF A LOCK

TECHNICAL FIELD

The present disclosure relates to detecting a change of a state of a lock, in particular of a lock operated by a mechanical key.

BACKGROUND

Securing a door with a door lock is an important protection of property against unwanted persons. However, the act of turning a key in the lock, as a routine task, is often easily forgotten. It happens that after some time since locking the door (turning the key in the door lock), the user cannot remember whether the door was actually locked or not. Even worse, sometimes the user forgets to lock the door and is not aware of it.

There are known methods which help to memorize the fact of turning the key in the lock. One is to use a mechanical signaling device in a form of a two-color plate (such as green and red), in which (depending on the state of the lock—locked or unlocked), only one part of the plate is visible (with one color), indicating the current state of the lock.

There are also known locks equipped with electronic systems that signal the state of the lock or a change of the state of the lock by emitting an audio signal or a light signal.

More advanced control techniques allow remote control of the state of the lock, or even operating the lock remotely. However, such systems are prone to hacking and may allow the hacker to access the door.

However, in the solutions presented above, it is necessary to equip the lock with additional, special mechanisms or an additional device for controlling the state of the lock.

There are also known solutions, wherein a rotation detection device is being attached to a key. However, the solutions known so far do not provide a reliable information regarding the change of the state of the lock, for example due to false indications when the key is rotated/turned outside of the lock (for example in a pocket, or when carrying the key in a hand).

SUMMARY OF THE INVENTION

There is disclosed a method for detecting a change of a state of a lock by means of a device connected to a key for that lock, the method comprising: measuring a change of a position of the key about three axes; indicating that the state of the lock has changed if the measured change of position of the key indicates that the key has rotated about a first axis by an angle greater than or equal to a primary threshold value and about the other two axes by an angle smaller than a secondary threshold value.

The first axis may coincide with an axis of the lock and the other two axes may be perpendicular to the first axis and to each other.

The value of rotation of the key may be calculated based on the variance with respect to an average rotation angle of the key during a particular measurement period.

The measurement period may be from 0.5 s to 2 s.

The primary threshold value may be at least 45°.

The primary threshold value may be defined during calibration of the device for a particular lock.

The method may further comprise connecting to a wireless token in a proximity of the device to determine the lock associated with that wireless token and providing information about the change of the state of the lock associated with that wireless token.

There is also disclosed a system for detecting a change of a state of a lock, the device comprising: a cap for attaching the device to a key; a three-axis inertial sensor for measuring a change of a position of the key about three axes, the sensor being integrated with the cap; and a signal analyzer that receives measurement data form the sensor and indicates that the state of the lock has changed if the measured change of position of the key indicates that the key has rotated about a first axis by an angle greater than or equal to a primary threshold value and about the other two axes by an angle smaller than a secondary threshold value.

The three-axis inertial sensor may be a three-axis gyroscope.

The three-axis inertial sensor may be a three-axis accelerometer.

The three-axis inertial sensor may comprise a three-axis gyroscope and a three-axis accelerometer.

The system may further comprise an activation switch for activating the signal analyzer.

The signal analyzer may be embedded in the cap.

The cap may further comprise a radio system for wireless communication with external devices remote to the cap.

The signal analyzer may be embedded in the external device.

These and other features, aspects and advantages of the invention will become better understood with reference to the following drawings, descriptions and claims.

BRIEF DESCRIPTION OF FIGURES

The method and the system disclosed herein are presented by means of example embodiments on a drawing, wherein.

DETAILED DESCRIPTION

The following detailed description is of the best currently contemplated modes of carrying out the invention. The description is not to be taken in a limiting sense, but is made merely for the purpose of illustrating the general principles of the invention.

Figure 1:
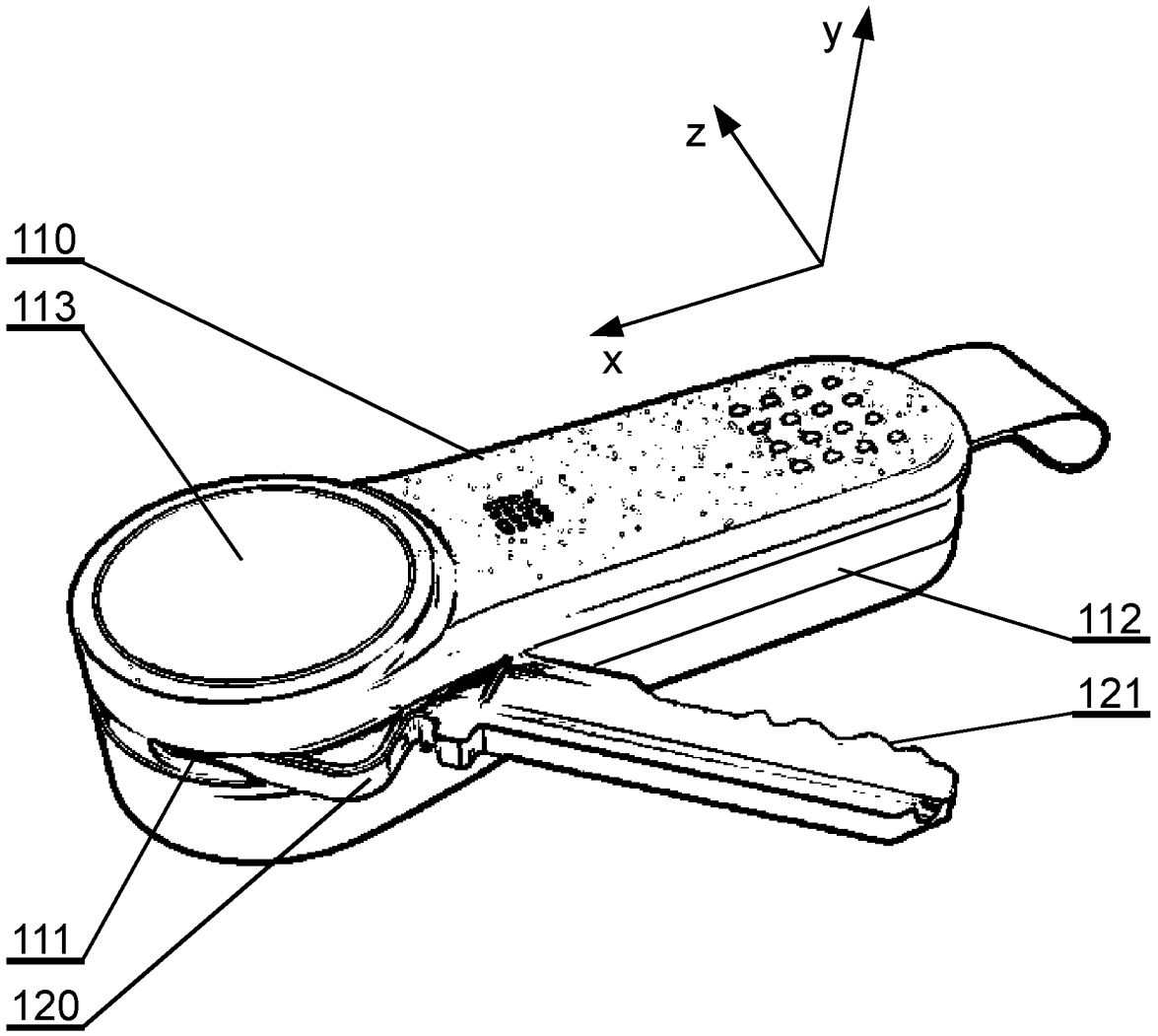
FIG. 1 presents a device, for detecting a change of a state of a lock, in a form of a key cap.

FIG. 1 presents a device, in a form of a key cap, for detecting a change of a state of a lock. A cap 110 comprises a socket 111 in which a key 120 is pivotally mounted. In an operating position, the key is located substantially in an axis of the cap, such that its shoulder, cuts and a tip are outside the contour of the cap. After locking or unlocking of the lock, the key may be rotated to a position in which it fits inside a recess 112 and does not protrude outside the contour of the cap. Retraction of the key to the operating position is initiated by a release button 113, which after pressing also initiates a switch 114, which activates the device. Inside the cap 110 there it an electronic system for detecting the rotation of the key 120 (along with the cap 110) in three axes (x, y, z). Inside the cap 110 there may also be a speaker for signaling an event (for example the change of the state of the lock) or for generating a signal that helps to find the key.

Figure 2:
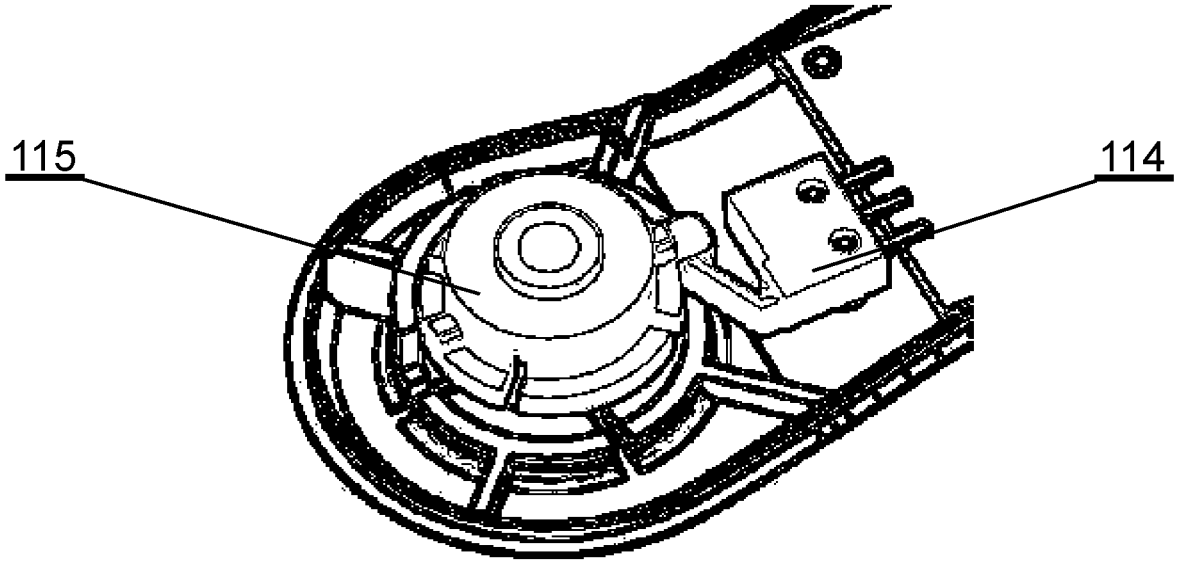
FIG. 2 presents an example of an activation switch a key mount.

FIG. 2 presents an example of a key mount 115 for mounting the key inside the socket 111 and an activation switch 114 located inside the cap 110. The rotation of the key causes rotation of the mount 115, wherein a protrusion of the mount initiates the activation switch 114, when the key is in the operating position.

Figure 3:
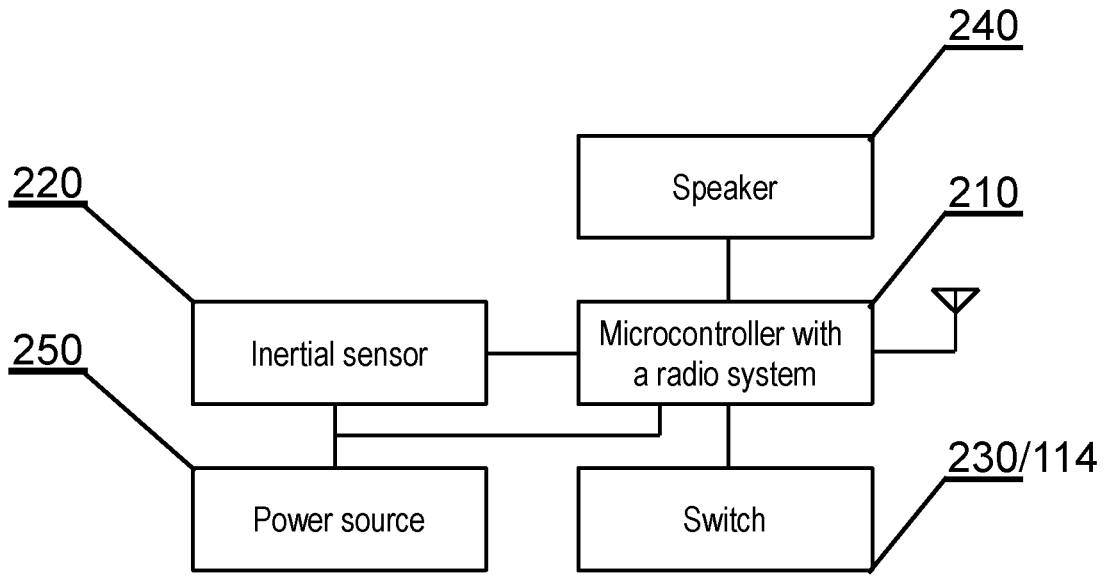
FIG. 3 presents a functional schematic of the system.

FIG. 3 presents a functional schematic of the system for detecting the change of the state of the lock. The system may be embedded in the cap 110 shown in FIG. 1 or its components may be shared between the cap 110 and an external device (such as a smartphone). The system comprises a microcontroller 210 with a radio system that allows wireless communication with external devices, an inertial rotation sensor 220 for detecting the rotation of the key about each axis x, y, z, a switch 230/114 for activating the device, a power source 250 (a battery) and optionally a speaker 240. The microcontroller 210 (incorporating signal analysis module) receives and analyzes signals from the inertial rotation sensor 220 that indicate a change of an orientation of the key in the three-dimensional space. Based on this analysis, it is possible to determine the angle of rotation of the key and the axis of rotation of the key. By comparing this data to reference data stored in a memory of the microcontroller 210, related to the characteristics of a particular lock, it is possible to determine whether the state of the lock has changed. Alternatively, data from the inertial rotation sensor 220 can be sent by the radio system of the microcontroller 210 to an external device, to perform the data analysis by a signal analysis module of that external device. The reference data of the lock are set-up during a calibration procedure, wherein the device reads and stores values of key rotation angles about each axis (x, y, z) during locking and unlocking the lock. The reference data of the lock may comprise, for example, data related to the number of revolutions (or angle of rotation) needed to lock and unlock the lock.

The inertial rotation sensor 220 comprises a three-axis accelerometer and a three-axis gyroscope. The accelerometer is used primarily to determine the starting position of the key inside the lock, i.e. just after inserting the key into the lock. At this point it is necessary to determine the position of the key with respect to the ground. After the key is inserted into the lock, the initial positions of the axes are determined before the key is rotated. For example, when the key is inserted to the lock horizontally, one of the axes (horizontal one) corresponds to the direction of inserting the key into the lock, and while the key is being rotated, that axis will remain in the same direction. The remaining two axes will rotate about this (horizontal) axis of rotation. The gyroscope is primarily used to detect a relative movement, i.e. after determining the starting position by the accelerometer. The gyroscope is able to accurately measure the angle of rotation even if the key is rotated relatively quickly. During the rotation of the key, both sensors can be used to interpolate their signals to provide increased detection accuracy.

The speaker 240, such as a piezoelectric speaker, may be mounted inside the cap in a spacer ring-shaped portion, with which the speaker forms a resonance chamber. The chamber and an opening having an appropriate diameter inside a housing of the cap may form an acoustic impedance matching system, which amplifies the sound intensity at a particular frequency range.

Figure 4:
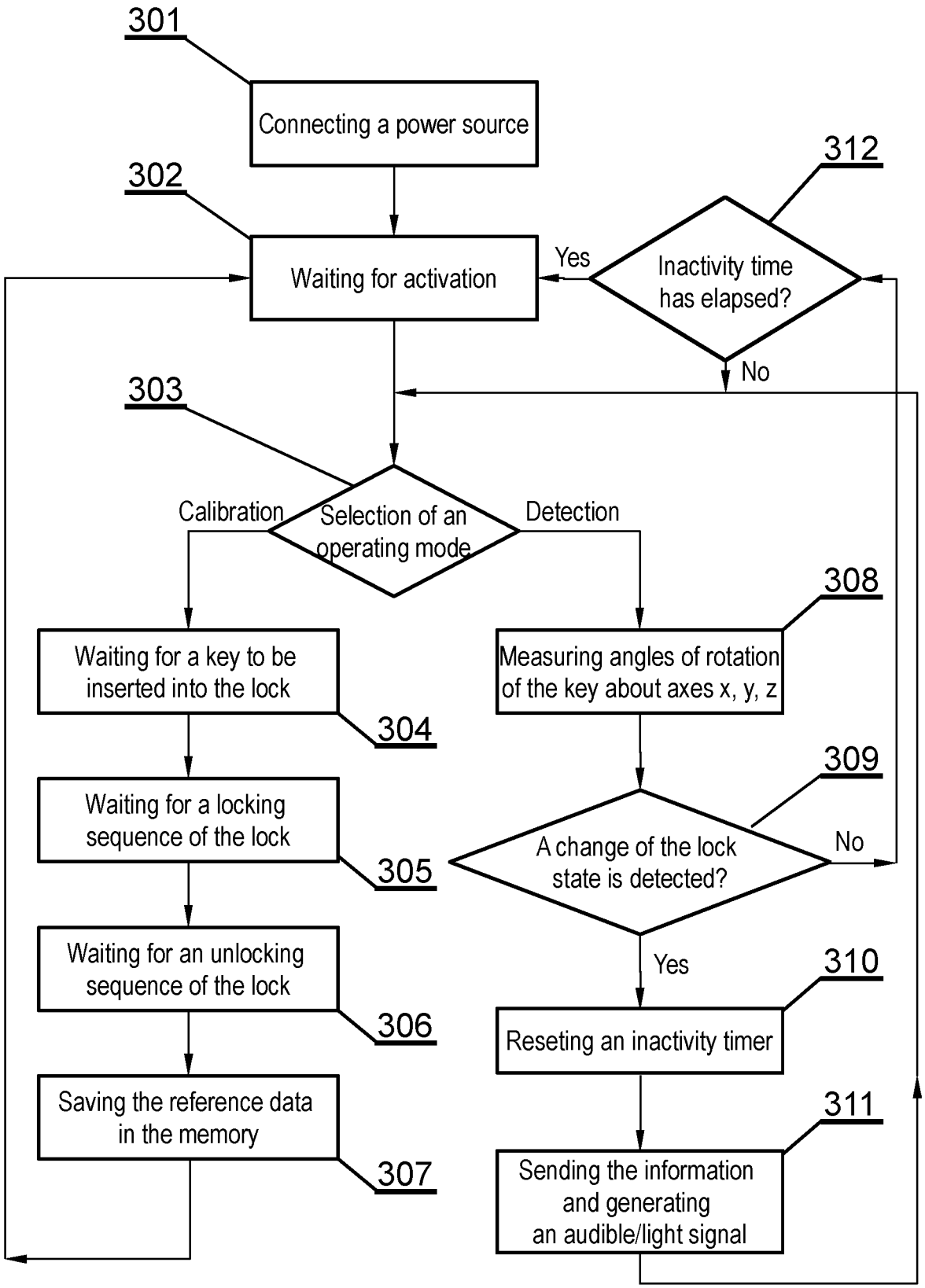
FIG. 4 presents a flowchart of a method for detecting a change of a state of a lock.

FIG. 4 presents a flowchart of a method for detecting a change of a state of a lock. First, in step 301, a power source is connected to the device. Next, in step 302, the procedure waits for the device to be activated, while the device is in a power saving mode. Next, in step 303, the mode of device operation is selected. The mode of operation may be selected by means of an external device. If a calibration mode is selected, then in step 304 the process waits for the key to be inserted into the lock. After the key is inserted into the lock, in step 305 the procedure waits to read a locking sequence of the lock, during which values of angles of rotation of the key about the axes x, y, z are measured. The readiness to proceed to the next step is indicated by the user, for example by means of a software application operated by the external device. Next, in step 306 the process waits to read an unlocking sequence of the lock, during which values of angles of rotation of the key about the axes x, y, z are measured. The locking sequence and the unlocking sequence determine the reference data for the particular lock. That reference data are later compared with respect to the values of the angles of rotation of the key in a state of the lock detection mode. Next, in step 307, the reference data are stored in the memory. The process continues to step 302, in which it awaits to be activated (it turns to the power saving mode). If in step 303 the mode of detection is selected, then the process moves to step 308, in which values of rotation of the key (changes of position of the key in space) about three axes (x, y, z) are measured. Next, in step 309 the measured angles of rotation of the key are compared with the reference values, to determine a change of state of the lock. The change of the state of the lock is considered to be detected when the angle of rotation of the key about one axis, called the first axis (for example about the axis x coinciding with the axis of the lock) is greater or equal to a preset primary threshold value and simultaneously when the angle of rotation of the key about the other two axes (axes y and z, which are perpendicular to the first axis x and are perpendicular to each other), is lower than a secondary threshold value. The threshold values are preset and stored in the calibration mode. For example the primary threshold value may be rounded off to a value equal to 45°, 90°, 180°, 360°, 540° or 720°. The secondary threshold value depends on the condition and tightness of the lock and is determined during the set-up stage, it is relatively small, typically smaller than 5°. The values of rotation of the key may be calculated based on a variance with respect to an average rotation value of the key in a particular measurement period. The measurement period may be equal from 0.5 s to 2 s. If the change of the state of the lock is detected, then in step 310 a timer of an inactivity period is reset. The inactivity period is a period that elapsed since the moment of device activation and lasts for a specified period or until the moment of detection of the change of the state of the lock. Next, in step 311, information concerning the change of the state of the lock is sent to the external device and (optionally, if the device is equipped with a speaker and/or a LED) an audible and/or a light signal is generated at the device. Next, the process moves to step 303, in which it awaits for the operation mode selection. If, in step 309, the change of the state of the lock is not detected, then the process moves to step 312, in which it is checked if the inactivity period has elapsed. If so, then the process moves to step 302 in which the device is turned to the power saving mode and awaits for activation. If in step 309 the change of the state of the lock is not detected and in step 312 the inactivity period has not elapsed, then the process moves to step 303 in which the process awaits for the operation mode selection.

Figure 5:
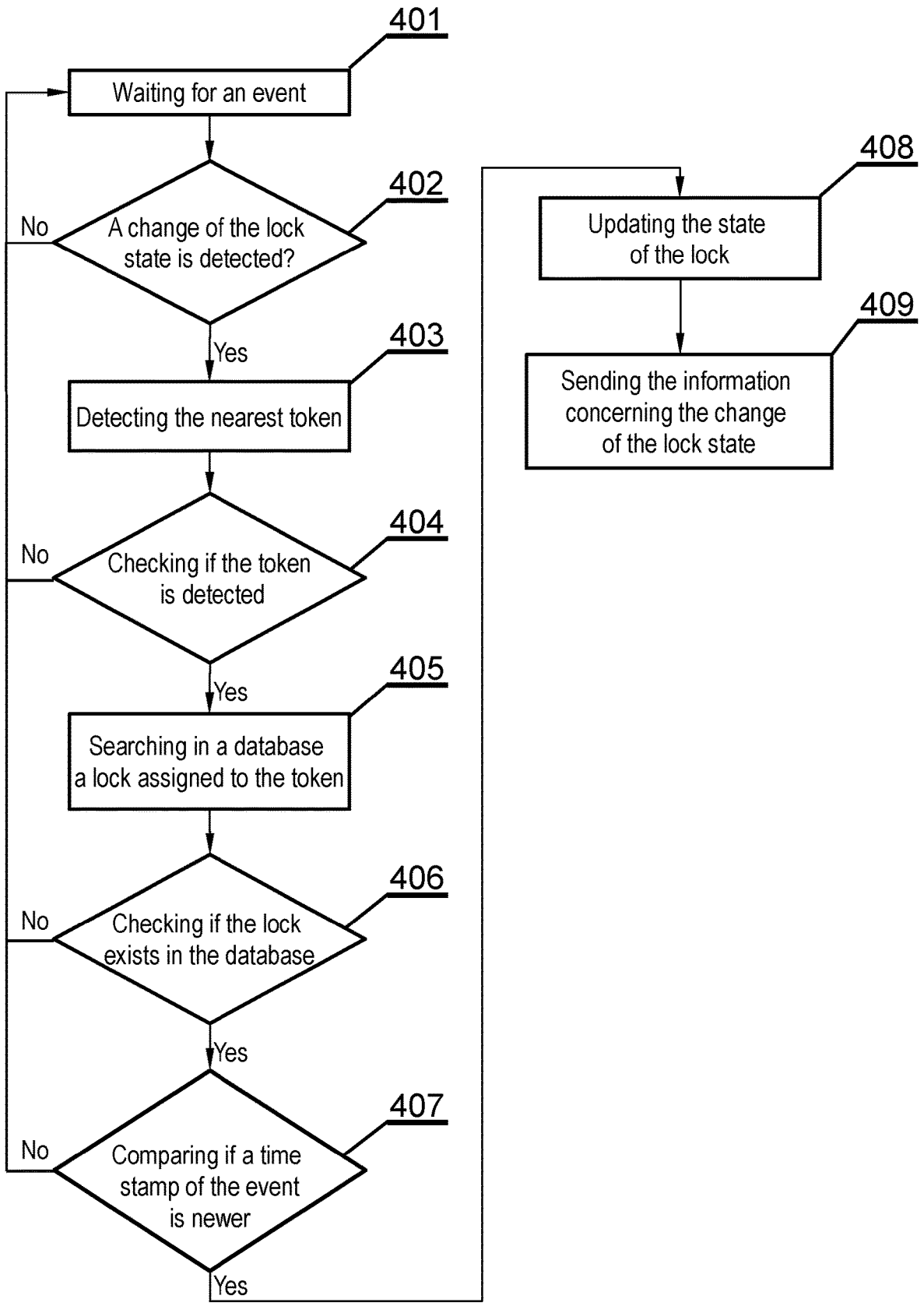
FIG. 5 presents a flowchart of a method for detecting a wireless token for a lock and for updating the state of the lock in a database.

FIG. 5 presents a flowchart of a method for detecting a wireless token for a lock and for updating the state of the lock in a database. This is useful when the device is mounted on a key which can lock or unlock multiple locks (in a so-called master key system). In such a case, a wireless token may be located in a proximity of each lock operable by that key (for example, an RFID token attached to the door or located inside the door), to allow identifying the lock for which the change state is to be detected.

First, in step 401 the procedure awaits for an event, such as activation of the device. Next, in step 402 the change of the state of the lock is detected (as explained with reference to FIG. 3). If the change of the state of the lock is not detected then the process loops back to the first step 401. If the change of the state of the lock is detected, then in step 403 the procedure attempts to establish a connection to the wireless token in the proximity of the device (e.g. by the radio system that handles the wireless communication protocol of the wireless token). In step 404, it is checked if the token is detected. If not, then the process loops back to step 401. Otherwise, if the wireless token has been detected, then the process moves to step 405 in which an identifier (ID) of the lock assigned to the particular token is searched in the database. The database comprises information concerning all user locks (for example the state of the lock and the associated ID of the lock (determining a number or a name of the lock)) together with the associated tokens. The wireless tokens may be associated to the locks set-up by the user in an on-demand token detection mode, in which the user present at a proximity of a particular lock activates the mode of detection of the token, after which the device assigns the identifier of the nearest lock (of the token with the highest signal value) to the identifier of the lock selected from the database. In step 406, it is checked if the lock assigned to the particular token identifier exists in the database. If not, the process returns to step 401. If the corresponding lock is found in the database, then the process moves to step 407, in which it is checked if a time stamp relating to the change of state of the lock corresponds to a time stamp stored in the database. If the time stamp relating to the event (the change of the state of the lock), is newer than the time stamp stored for the particular lock in the database, then the process moves to step 408, in which the state of the lock in the database is updated. If in step 407 the time stamp is not newer, then the process loops back to the first step 401. Finally, in step 409 the information concerning the change of the state of the lock is sent to the external device.

By measuring rotation of the key about three axes and by comparing the values with the reference data set-up in the calibration mode, the presented method and device allow to limit erroneous indications of the change of the state of the lock, which are usually caused by rotating the key outside the lock. In particular, by calculating the variance for two axes being perpendicular to the axis of the lock, it is possible to determine if the key during its rotation about the third axis was actually inside the lock.

While the invention has been described with respect to a limited number of embodiments, it will be appreciated that many variations, modifications and other applications of the invention may be made. Therefore, the claimed invention as recited in the claims that follow is not limited to the embodiments described herein.

The invention claimed is:

1. A method for detecting a change of a state of a lock by means of a device connected to a key for that lock, the method comprising:

detecting selection of a calibration mode and subsequently:

determining initial positions of three axes at a starting position of the key inside the lock, wherein said three axes include a first axis corresponding to the axis of the lock, and two other axes perpendicular to each other and to the first axis;

reading a locking sequence of the lock by measuring values of angles of rotation of the key about said three axes and storing said values as reference values for the locking sequence;

reading an unlocking sequence of the lock by measuring values of angles of rotation of the key about said three axes and storing said values as reference values for the unlocking sequence:

detecting selection of a detection mode and subsequently:

measuring a change of a position of the key by measuring values of angles of rotation of the key about said three axes during a measurement period;

indicating that the state of the lock has changed if the measured change of position of the key during the measurement period indicates that the key has rotated about said first axis by an angle greater than or equal to a primary threshold value that corresponds to the value of rotation of the key about the first axis by at least 45 degrees stored as the reference value for the locking sequence or for the unlocking sequence, and about the other two axes by an angle smaller than a secondary threshold value that corresponds to the value of rotation of the key about the other two axes stored as the reference value for the locking sequence or for the unlocking sequence.

2. The method according to claim 1, wherein the value of rotation of the key is calculated based on the variance with respect to an average rotation angle of the key during the measurement period.

3. The method according to claim 2, wherein the measurement period is from 0.5s to 2s.

4. The method according to claim 1, further comprising connecting to a wireless token in a proximity of the device to determine the lock associated with that wireless token and providing information about the change of the state of the lock associated with that wireless token.

5. A system for detecting a change of a state of a lock, the device comprising:

a cap for attaching the device to a key;

a three-axis inertial sensor for measuring a change of a position of the key about three axes, the sensor being integrated with the cap;

a signal analyzer that receives measurement data from the sensor and is configured to:

detect selection of a calibration mode and subsequently:

determine initial positions of three axes at a starting position of the key inside the lock, wherein said three axes include a first axis corresponding to the axis of the lock, and two other axes perpendicular to each other and to the first axis;

read a locking sequence of the lock by measuring values of angles of rotation of the key about said three axes and storing said values as reference values for the locking sequence;

read an unlocking sequence of the lock by measuring values of angles of rotation of the key about said three axes and storing said values as reference values for the unlocking sequence;

detect selection of a detection mode and subsequently:

measure a change of a position of the key by measuring values of angles of rotation of the key about said three axes during a measurement period;

indicate that the state of the lock has changed if the measured change of position of the key during the measurement period indicates that the key has rotated about said first axis by an angle greater than or equal to a primary threshold value that corresponds to the value of rotation of the key about the first axis by at least 45 degrees stored as the reference value for the locking sequence or for the unlocking sequence, and about the other two axes by an angle smaller than a secondary threshold value that corresponds to the value of rotation of the key about the other two axes stored as the reference value for locking sequence or for the unlocking sequence.

6. The system according to claim 5, wherein the three-axis inertial sensor is a three-axis gyroscope.

7. The system according to claim 5, wherein the three-axis inertial sensor is a three-axis accelerometer.

8. The system according to claim 5, wherein the three-axis inertial sensor comprises a three-axis gyroscope and a three-axis accelerometer.

9. The system according to claim 5, further comprising an activation switch for activating the signal analyzer.

10. The system according to claim 5, wherein the signal analyzer is embedded in the cap.

11. The system according to claim 5, wherein the cap further comprises a radio system for wireless communication with external devices remote to the cap.

12. The system according to claim 11, wherein the signal analyzer is embedded in the external device.

* * * * *